United States Patent [19]

Misevich et al.

[11] Patent Number: 4,542,598

[45] Date of Patent: Sep. 24, 1985

[54] ATHLETIC TYPE SHOE FOR TENNIS AND OTHER COURT GAMES

[75] Inventors: Kenneth W. Misevich, Fairfield, Conn.; Henry D. Cross, III, Colts Neck, N.J.; Roland E. Dube, Auburn, Me.; Rob R. McGregor, Concord, Mass.

[73] Assignee: Colgate Palmolive Company, New York, N.Y.

[21] Appl. No.: 456,779

[22] Filed: Jan. 10, 1983

[51] Int. Cl.[4] ..... A45B 5/10

[52] U.S. Cl. ..... 36/114; 36/107; 36/108

[58] Field of Search ..... 36/10.7, 108, 114, 25 R, 36/30 R, 32 R, 76 R, 72 C, 28, 103, 97

[56] References Cited

U.S. PATENT DOCUMENTS

| | | | |
|---|---|---|---|
| Re. 27,512 | 10/1972 | Onitsuka | 36/114 |
| 300,854 | 6/1884 | Dexter | 36/32 R |
| 1,390,698 | 9/1921 | Golden . | |
| 1,582,260 | 3/1926 | Furber | 36/30 A |
| 2,049,604 | 8/1936 | Cristallini | 36/108 |
| 2,111,620 | 4/1938 | Gilkerson | 36/30 A |
| 2,209,280 | 7/1940 | Noonan et al. | 36/30 A |
| 2,222,391 | 11/1940 | Andreasen | 36/28 |
| 2,252,315 | 8/1941 | Doree | 36/97 |
| 2,773,316 | 12/1956 | Clappier . | |
| 3,300,880 | 1/1967 | Campagna . | |
| 3,414,988 | 12/1968 | Mattos . | |
| 3,416,245 | 12/1968 | Ferreira . | |
| 3,566,486 | 3/1976 | Conway | 36/114 |
| 4,128,950 | 12/1978 | Bowerman . | |
| 4,155,180 | 5/1979 | Phillips | 36/103 |
| 4,204,346 | 5/1980 | Fugere | 36/114 |
| 4,297,796 | 11/1981 | Stirtz et al. . | |
| 4,378,642 | 3/1983 | Light et al. . | |
| 4,389,798 | 6/1983 | Tilles | 36/32 R |
| 4,412,393 | 11/1983 | Terlizzi | 36/108 |

FOREIGN PATENT DOCUMENTS

| | | | |
|---|---|---|---|
| 597644 | 1/1933 | Fed. Rep. of Germany | 36/97 |
| 797027 | 3/1936 | France | 36/97 |
| 1266620 | 7/1961 | France | 36/97 |

*Primary Examiner*—Werner H. Schroeder
*Assistant Examiner*—Mary A. Ellis
*Attorney, Agent, or Firm*—LeBlanc, Nolan, Shur & Nies

[57] ABSTRACT

An athletic type tennis or court shoe wherein spaced apart forefoot and rearfoot sole units are connected together only through a flexible soleless coupling to allow the wearer's forefoot and rearfoot to act independently of each other, wherein each sole unit has a resilient, shock-absorbing midsole, and wherein the sole units are sufficiently thin to place the wearer's foot close to the ground while maintaining sufficient cushioning for the wearer's foot.

29 Claims, 9 Drawing Figures

ATHLETIC TYPE SHOE FOR TENNIS AND OTHER COURT GAMES

FIELD OF INVENTION

This invention relates to athletic shoes of the type which are especially designed for tennis and other court games involving similar footwork.

DEFINITIONS

In this specification (including the claims) the term "rearfoot" is used to identify the heel portion of the foot containing the heel bone (the calcaneus) and the talus, the term "forefoot" is used to identify the portion of the foot containing the metatarsals and the phalanges (the toes), and the term "midfoot" is used to identify the foot portion lying between the forefoot and rearfoot as defined above. The midfoot therefore lies rearwardly of the proximal facets of the metatarsals and forwardly of the calcaneus and contains the cuboid, the navicular and the cuneiforms.

BACKGROUND

The present day tennis shoe is typically constructed with a thick outsole/midsole unit of molded rubber and/or foamed polymeric material, which extends throughout the full length of the shoe for cushioning the foot and protecting it against impacts. In addition, the midsole unit usually embodies a cushioning heel wedge extending along the midfoot and rearfoot regions. The heel wedge provides the heel lift which is desired for running.

Because of its thick cushioning, the foregoing sole construction amply meets the wearer's comfort requirements. However, this construction has now been found to have certain significant drawbacks for playing tennis and other court games involving similar footwork.

First of all, the foregoing sole construction abnormally restricts the natural foot motions required to perform various tennis maneuvers which involve more than just straight ahead running. For example, the tennis player frequently springs or crouches on the balls or toes of his feet, makes abrupt stops after pushing off and sprinting short distances, pivots or turns sharply on the ball of one foot or the other, skips or runs sideways, and makes abrupt changes in direction of movement. The wide variety of foot motions required to execute these maneuvers is hampered by the foregoing sole construction mainly because it stiffens the shoe significantly in the midfoot region to inhibit the extent to which the forefoot and rearfoot can act independently of each other.

Additional problems arise from the fact that the foregoing sole construction places the foot at a significant height (Usually one inch or more at the heel) above the ground surface. For example, the higher the foot is above the ground the more difficult it is for the player to balance himself and to maintain his stability in executing the tennis maneuvers mentioned above. Furthermore, the forces acting on the foot and also the force moments about the foot joints are increased as the height of the foot above the ground is increased.

In addition, the likelihood of jamming or twisting the foot during a stopping maneuver is increased as the height of the foot above the ground is increased, especially with shoe constructions having sharp outsole edges. If the forces are applied to the foot joint before full foot support is attained in a stopping maneuver, unnatural conditions tend to arise and may lead to injuries. For example, upon stopping a lateral motion, the outer edge of the shoe may catch on the court, causing the shoe to roll over, thereby increasing the likelihood of ankle sprains. In stopping a forward motion, a high heel, especially one having relatively sharp edges, tends to catch on the court surface to increase the impact of the forefoot on the court surface. Finally, increasing the height of the heel above the ground increases the angle through which the wearer must lean in a forward direction to lift the heel and to lock the midfoot for propelling himself. If the player attempts to pivot while his heel is down on the ground, the resulting heel traction causes the foot to lock up to apply an objectionable torque to the knee.

Aside from the thickly cushioned sole construction described above, other shoe parts contribute to the restriction of natural foot movements. For example, medical longitudinal arch supports and lateral edges tend to increase the stiffness of the shoe in the midfoot region.

In addressing the foregoing problems, it was recognized that the natural foot motion required for tennis and other court games are best achieved with bare feet without introducing any artificial constraints on the foot motions and without elevating the foot above ground level. Therefore, the optimum solution to the foregoing problems is to eliminate the shoe altogether and to play barefooted. However, the obvious drawback to such a solution is that playing barefooted on hard court surfaces for any prolonged period of time is uncomfortable and hard on the feet.

SUMMARY AND OBJECTS OF THE INVENTION

With the foregoing in mind, the general aim and purpose of this invention is to provide a novel and improved tennis or court shoe which places the foot as low to the ground as possible and which allows the foot to function in virtually its natural, unrestrained barefooted manner while maintaining sufficient cushioning to satisfy the wearer's comfort requirements and to protect the foot against impacts.

In carrying out the invention, the tennis shoe shown in the accompanying drawings is constructed with spaced apart forefoot and rearfoot sole units which are coupled together only through a soleless, pliable, sliplasted midfoot portion of the upper. The upper's sliplasted midfoot portion thus defines a highly flexible, soleless, universal coupling between the two sole units to allow virtually unrestrained relative motion between the wearer's heel and forefoot. The heel and forefoot are therefore free to act independently of each other in a natural, barefooted manner.

The tennis shoe of this invention is also devoid of any longitudinal medial arch support. The arch support throws the body weight towards the shoe's lateral border, making the shoe more comfortable for walking and standing, but causing the midfoot to supinate and unlock. This condition is undesirable for tennis.

In this invention, both the forefoot and rearfoot sole units are provided with relatively thin midsoles which are formed from a suitable, shock-absorbing foamed polymeric material to cushion the foot and to protect it against impacts. The shock-absorbing midsole in the heel sole unit is preferably of uniform thickness and incorporates a special stiffening plate which allows the midsole thickness to be reduced by a significant extent without noticeably reducing the degree of cushioning and shock-absorption afforded by the midsole. The reduced sole thickness thus places the wearer's heel very close to the ground at about the same level of the forefoot so that the wearer has the feeling of being as flat-footed as he would if he were barefooted. The reduced height of the heel above the ground in turn reduces the impacts on the forefoot, thus allowing a reduction in the thickness of the shock-absorbing midsole in the forefoot sole unit without creating discomfort.

The sliplasted tennis shoe of this invention advantageously includes a forefoot board which lies just in the forefoot region. By more uniformly distributing the load acting on the midsole in the forefoot region, the forefoot board permits a further reduction in the forefoot midsole thickness without diminishing the cushioning and shock-absorbing properties of the shoe.

The forefoot board performs the additional function of resisting the tendency of the shoe to deform into an oval configuration where the shoe bottom curls up to reduce the shoe's resistance to foot roll. In resisting such deformation, the forefoot board maintains a flattened shoe bottom which affords greater resistance to foot roll and which thereby assists the wearer in maintaining his balance while executing the various tennis maneuvers mentioned above.

In addition to the foregoing, the edges of the forefoot and rearfoot outsoles are smoothly rounded to avoid the previously mentioned problems arising from sharp edged outsoles.

The upper is formed from pliable, highly flexible materials and has a soft, pliable form-fitting heel cup which is devoid of any stiff heel counter for a better fit. The upper is also formed with a pliable wrap-around saddle which extends along the sides and all the way around the bottom of the soleless midfoot region between the forefoot and rearfoot sole units. When the shoe is laced up, the saddle provides a secure girth-like grip around the foot in the midfoot region and flexibly hugs the foot just in the midfoot region without constraining the natural motions of the different parts of the foot.

By placing the foot as low to the ground as possible and by removing all significant shoe-imposed constraints on the foot, the foot is capable of acting in a natural barefooted manner to make it easier for the player to execute the various tennis maneuvers on the court. Furthermore, by eliminating the heel wedge and placing the forefoot and rearfoot at approximately the same low level, the player is induced to assume a correct tennis posture where he is up on the balls of his feet to address the ball. In addition, the shoe of this invention is lighter than the typical present day tennis shoe.

Further objects of this invention will appear as the description proceeds in connection with the below-described drawings and appended claims.

DETAILED DESCRIPTION

Figure 1:
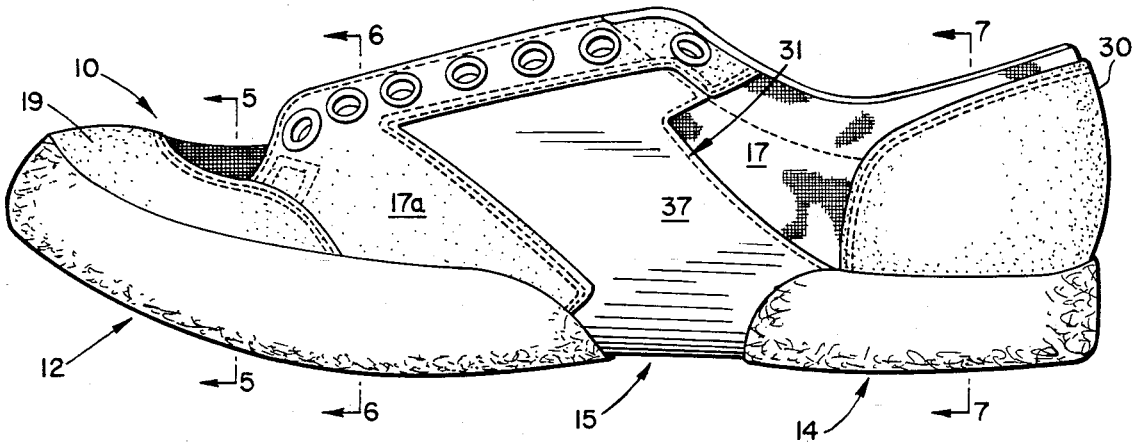
FIG. 1 is a side elevation of a right foot tennis shoe incorporating the principles of this invention as viewed from the medial side of the shoe.
Figure 2:
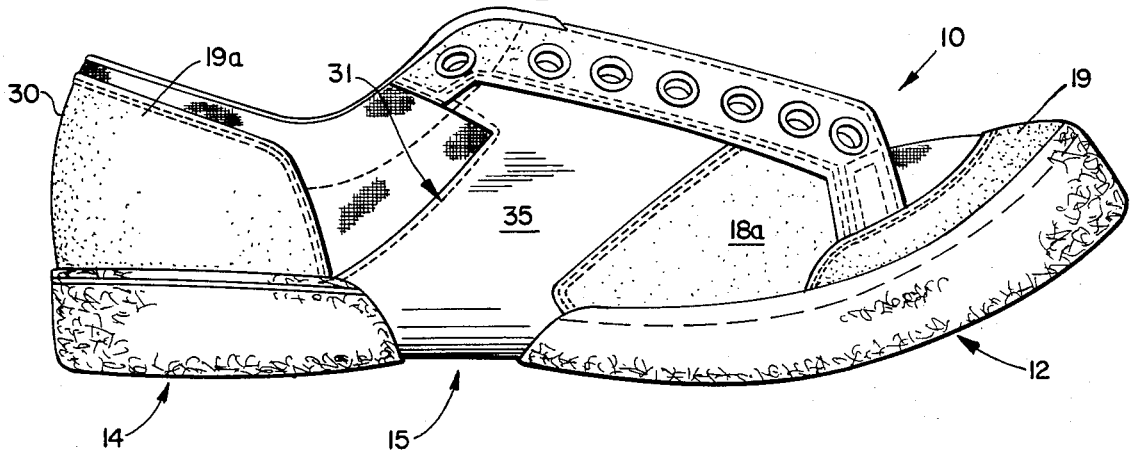
FIG. 2 is a side elevation of the shoe shown in FIG. 1 as viewed from the lateral side of the shoe.
Figure 3:
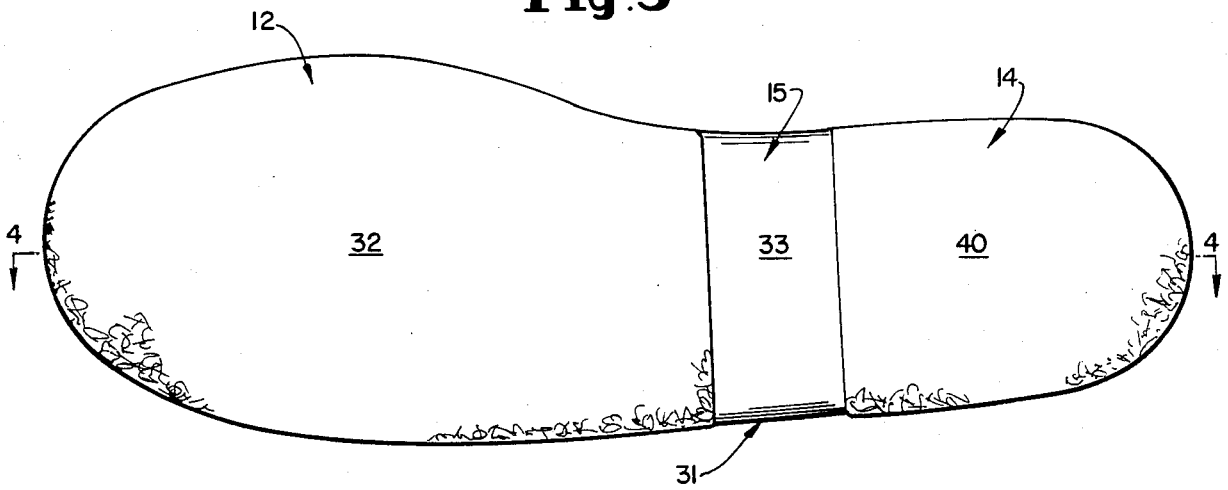
FIG. 3 is a bottom plan view of the shoe shown in FIGS. 1 and 2.

Referring to the drawings and particularly to FIGS. 1-4, the tennis shoe of this invention mainly comprises a flexible upper 10 and separate, spaced apart forefoot and rearfoot sole units 12 and 14. As best shown in FIG. 3, the tennis shoe is soleless in the midfoot region which lies between sole units 12 and 14. The soleless midfoot region provides a highly flexible, universal coupling 15 which couples sole units 12 and 14 together in a manner to be described in detail later on.

Upper 10 is formed from any suitable, pliable materials and is of the sliplasted type which extends completely around the wearer's foot like a slipper to form a closed bottom 16 underlying the foot. In the illustrated embodiment, for example, upper 10 comprises a pair of fabric panels 17 and 18, a pair of leather panels **17*a* and 18*a*, a leather toe cap 19 and leather foxing 19*a*. As shown, panels 17 and 18** may be a laminated construction having inner and outer fabric layers separated by a soft intermediate sponge layer.

Figure 8:
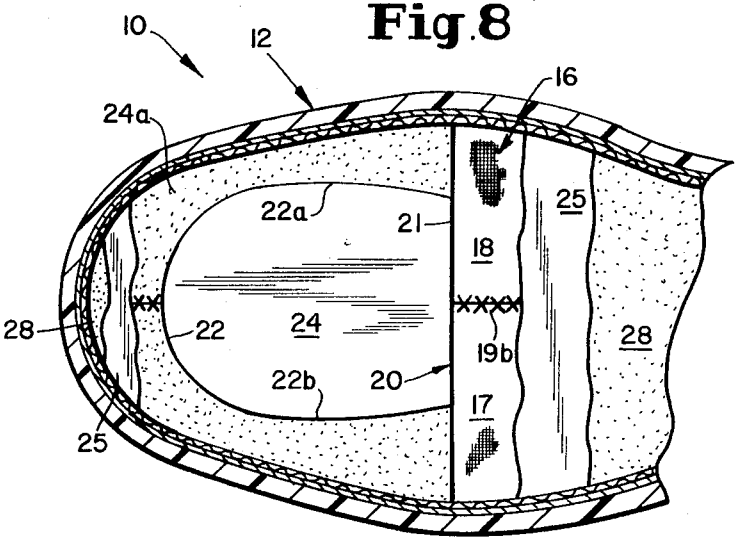
FIG. 8 is a section taken along lines 8—8 of FIG. 4.
Figure 6:
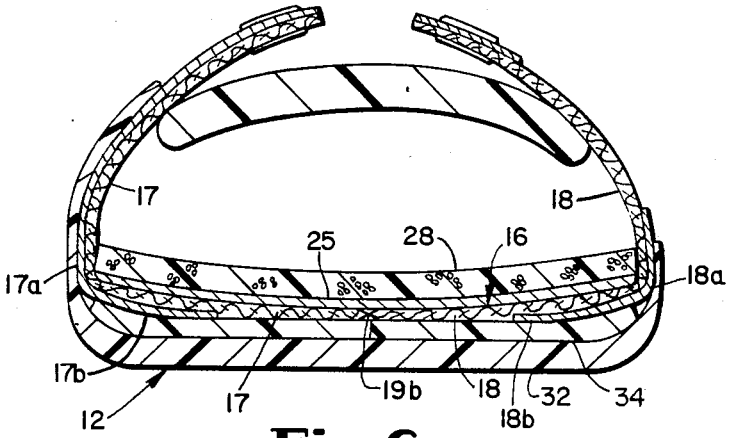
FIG. 6 is another transverse section taken along lines 6—6 of FIG. 1.
Figure 7:
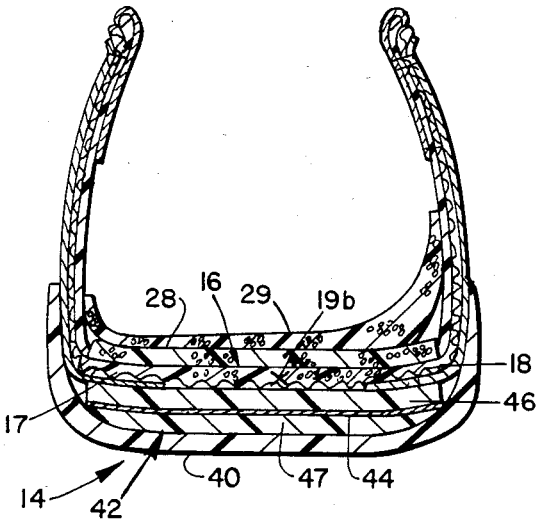
FIG. 7 is yet another transverse section taken along lines 7—7 of FIG. 1.

As shown in FIGS. 6-8, fabric panels 17 and 18 are sewn together along the upper's bottom 16 as indicated at **19*b* in FIGS. 6-8. Panels 17 and 18 define the main layer of bottom 16 and extend upwardly from the bottom to define the opposite sides of the upper. Panels 17*a* and 18*a*, toe cap 19 and foxing 19*a* lie exteriorly of fabric panels 17 and 18 and are sewn or otherwise suitably attached to panels 17 and 18**.

Figure 4:
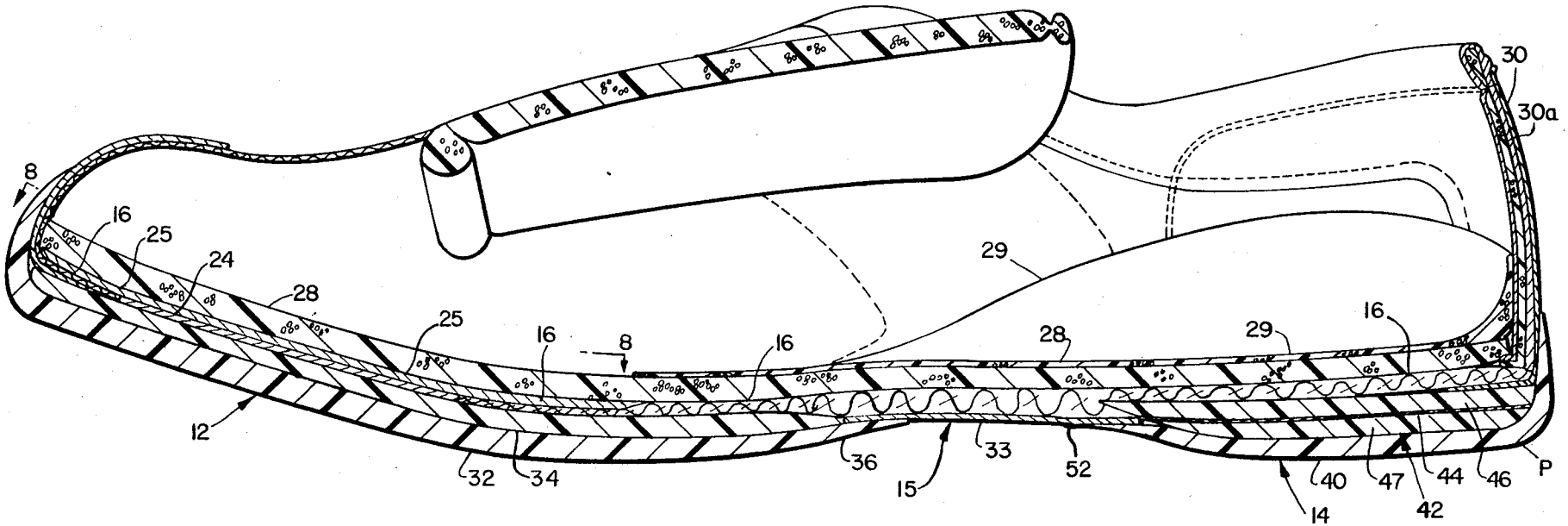
FIG. 4 is a longitudinal section taken along lines 4—4 of FIG. 3.

The leather panels **17*a* and 18*a* extend along opposite sides of upper 10 and have bottom portions 17*b* and 18*b* (see FIG. 6) underlying the bottom portions of fabric panels 17 and 18. Toe cap 19 and foxing 19*a* also have bottom portions underlying the bottom portions of fabric panels 17 and 18 as shown in FIGS. 4 and 7. From this description it will be appreciated that the upper's bottom 16 is formed by the bottom portions of panels 17 and 18 and the underlying bottom portions of panels 17*a* and 18*a*, toe cap 19 and foxing 19*a*. It is understood, however, that the bottom and other parts of upper 10** may be of any suitable construction.

As best shown in FIGS. 4 and 8, bottom 16 is cut away just in the forefoot region to define a single opening 20 in the toe region. Opening 20 is delimited by a straight rear edge 21, a curved front edge 22 and generally parallel side edges **22*a* and 22*b*. A thin, stiff, flat-sided toe plate 24 is interfittingly positioned in opening 20 to fill the opening. Upper 10 is therefore completely closed along its bottom. Toe plate 24** underlies the wearer's three middle toes forwardly of the metatarsal heads.

A flat-sided forefoot insole board 25 is disposed in upper 10 and overlies toe plate 24 and part of bottom 16. Insole board 25 spans the interior width of the upper in the forefoot region and extends from the toe end of upper 10 to the region just rearwardly of the metatarsal heads of the wearer's foot. By this construction, board 25 underlies part of the wearer's forefoot, but terminates forwardly of the midfoot so that is does not impair the flexibility of the midfoot coupling 15. Board 25 overlies the portion of bottom 16 lying between toe plate 24 and the toe end of upper 10. In addition, board 25 overlaps the portion of bottom 16 lying just rearwardly of toe plate 24 under the ball of the wearer's foot.

Toe plate 24 and insole board 25 may each be formed from a suitable, non-resilient, substantially incompressible fiberboard. The thicknesses of plate 24 and board 25 are about equal, each being less than about 0.062".

A soft, pliable sponge sockliner 28 is disposed in upper 10 and extends the full length of the upper. The shoe may optionally include a soft, pliable heel pad 29 (see FIG. 4) in the rearfoot region. In the illustrated embodiment, heel pad 29 overlies sockliner 28. Alternatively, heel pad 29 may lie between sockliner 28 and bottom 16 in the rearfoot region of the shoe.

As shown in FIG. 4, sockliner 28 overlies and is adhered to board 25 and the portion of bottom 16 lying rearwardly of board 25. Board 25, in turn, is adhered to the opposing surfaces of toe plate 24 and the bottom portions of panels 17 and 18. Board 25 is therefore sandwiched between sockliner 28 on one side and by toe plate 24 and bottom 16 on the other side.

Hard, hot melt glue is used to adhere board 25 throughout the bottom portions of panels 17 and 18 lying forwardly of the rearward edge of toe plate 24. Upon solidifying the hot melt glue forms a stiff, thin, continuous layer **24*a* lying at least approximately in a plane containing toe plate 24 and covering the entire fabric bottom area lying forwardly of edge 21 of opening 20. Plate 24 and layer 24*a* therefore cooperate to define a continuous, stiff, flat-sided layer or plate structure underlying board 25 and covering the upper's entire forefoot bottom area from the toe end of upper 10 back to a vertical, transverse plane containing edge 21 of opening 20**.

Layer **24*a*** is the only region of the shoe in which hard hot melt glue is used. All other shoe parts requiring gluing are adhered to adjacent surfaces by a suitable non-stiffening glue or adhesive (such as an elastomeric or rubber-based glue) which remains flexible in its final adhesive state so as not to impair the flexibility of different parts of the shoe.

It will be noted that the shoe is devoid of any longitudinal medial arch support. The upwardly facing foot-supporting surface of the sockliner 28 is therefore generally flat and lies close to the ground throughout the region underlying the wearer's arches.

As shown in FIGS. 1, 2 and 4, upper 10 is formed with a soft, pliable heel cup 30 which is devoid of a functional heel counter or any other similar heel constraining device. Heel cup 30 is formed from soft, pliable layers which do not constrain the natural movement of the wearer's heel. Heel cup 30 is smoothly contoured to comfortably fit the wearer's heel. Heel cup 30 may include a narrow stiffening finger **30*a* (see FIG. 4) having a width of about ¾" and extending just along the back of the heel to keep the back of heel cup 30 from sagging. It will be appreciated that stiffening finger 30*a*** is used only for cosmetic purposes.

As shown in FIGS. 1–4, upper 10 is provided with an exterior, one-piece, wrap-around saddle 31 having a bottom portion 33 and side portions 35 and 37. Bottom portion 33 underlies and is adhered or sewn to the bottom portions of panels 17 and 18 in the shoe's midfoot region. By this construction, the saddle's bottom portion 33 forms an exterior layer of bottom 16 in the midfoot region and bridges sole units 12 and 14. The flexible midfoot portion of bottom 16, which contains the saddle's bottom portion 33 and which interconnects sole units 12 and 14, is soleless to define the unsoled flexible coupling 15 between sole units 12 and 14. The saddle's side portions 35 and 37 extend along opposite sides of the shoe, terminate at their upper ends at the shoe's eye stay portions and are stitched or otherwise fixed to panels 17 and 18, respectively. Saddle 31 is formed from any suitable flexible material such as vinyl or leather.

As best shown in FIG. 4, the forefoot sole unit 12 underlies just the forefoot region below bottom 16 and comprises a flexible, ground-engaging outsole 32 and a relatively thin, flexible, resilient midsole 34. The forefoot sole unit 12 is comparable to a half-sole and terminates at the interface between the wearer's forefoot and midfoot.

Still referring to FIG. 4, midsole 34 lies between and is adhered to outsole 32 and the composite of bottom 16 and toe plate 24. Midsole 34 extends rearwardly from the toe end of the shoe and terminates rearwardly of board 25 at the interface between the forefoot and midfoot regions.

Midsole 34 is formed from a suitable, shockabsorbing, foamed, closed cell polymeric material. Preferably, midsole 34 is formed from ethylene-vinyl acetate (EVA) having a low shear modulus to enhance to the shear property of the midsole.

As shown in FIGS. 1–4, outsole 32 extends upwardly along the front toe portion of the shoe and also upwardly along the lateral and medial sides of the shoe. All of the corners of outsole 32 are smoothly rounded to eliminate any sharp corner edges which would tend to catch on a court surface.

The rear edges of outsole 32 and midsole 34 are tapered to smoothly merge with the unsoled midfoot portion of bottom 16. Except for these tapered ends, midsole 34 and the underlying portion of outsole 32 are each of uniform thickness.

As shown in FIG. 4, the taper at the rear end of outsoles 32 forms a thin, flexible lip 36. Lip 36 extends a short distance beyond midsole 34 and is adhered to the overlying forward end region of saddle bottom 33.

The forefoot midsole 34 performs two major functions. First, it cushions the wearer's forefoot and absorbs shock due to impact of the foot on hard court surfaces. Second, because of its low shear modulus, it will shear in all directions in a plane parallel to the court surface, allowing relative horizontal movement in all directions between outsole 32 and board 25 and, hence, between outsole 32 and the wearer's foot. Outsole 32 is therefore capable of moving relative to board 25 and sockliner 28. This built-in shearing action of midsole 34 has two significant benefits.

First, it reduces the extent of sliding on the court surface, which, in turn, reduces wear-producing abrasion to increase the functional life of the shoe. Second, the foot has less tendency to jam in the shoe especially when the wearer makes an abrupt stop on the court surface.

The forefoot board 25 also performs a number of important functions. Without it, the soled, foot-supporting bottom of the shoe may curve or curl up in the forefoot region so that in cross-section the shoe's forefoot portion assumes an unstable oval configuration which increases the likelihood of foot roll about the shoe's longitudinal axis. As a result, the wearer encounters difficulty in balancing himself while making the previously mentioned tennis maneuvers, especially those requiring the player to be up on the balls or toes of his feet.

Figure 5:
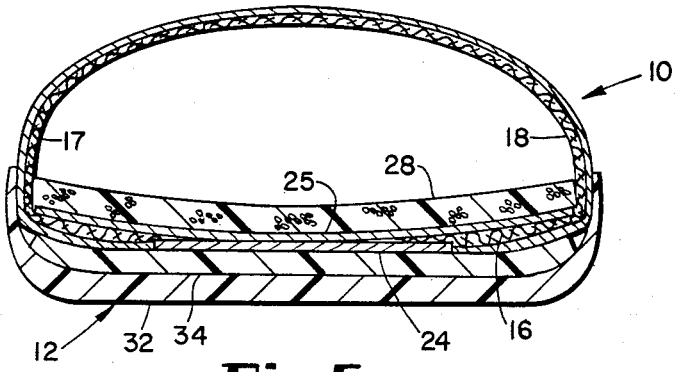
FIG. 5 is a transverse section taken along lines 5—5 of FIG. 1.

In avoiding the foregoing problem, forefoot board 25 opposes deformation of the shoe into the unstable oval configuration and is sufficiently stiff to maintain the shoe's forefoot support portion flat or at least substantially flat in transverse cross-section throughout the full interior width of the shoe as seen, for example, in FIGS. 5 and 6. Board 25 thereby maintains a stable shoe configuration which resists foot roll to enhance the wearer's balance. Furthermore, by keeping the shoe's forefoot support portion flat or straight across its width, the wearer's toes are allowed to spread naturally within the limits imposed by the maximum width of the shoe, making it easier for the wearer to balance himself when he is up on the balls or toes of his feet.

The forefoot board 25 also is sufficiently stiff to distribute the load of the wearer more uniformly throughout midsole 34. This load distribution enhances the cushioning and shock-absorbing properties of the midsole and allows the thickness of midsole 34 to be reduced by a significant extent without any significant trade-off in the cushioning and shock-absorbing properties of the midsole. On the other hand, board 25 is not so stiff as to make the shoe feel uncomfortably hard.

Toe plate 24 is stiffer than board 25. It and layer 24*a* reinforce board 25 in the region underlying the wearer's toes to provide extra firmness which prevents the wearer's toes from digging into midsole 34. Toe plate 24 and layer 24*a* also provide additional protection to the entire forefoot during dragging of the foot and toe bumps. Instead of being brittle or rigid, plate 24, layer 24*a* and board 25 are each somewhat flexible transversely of the shoe's longitudinal axis.

The rearfoot sole unit 14 underlies just the wearer's rearfoot or heel below bottom 16 and comprises a ground-engaging outsole 40, a resilient, shock-absorbing midsole 42, and a flat-sided heel plate 44. Midsole 42 is horizontally divided into upper and lower flat-sided layers 46 and 47 which are formed from closed-cell foamed EVA or other suitable elastically deformable shock-absorbing foamed closed-cell polymeric material. Outsoles 32 and 40 are formed from any suitable tough, elastically deformable wear-resistant material.

Heel plate 44 lies between and is adhered to the opposing flat surfaces of midsole layers 46 and 47 so that the plate is confined in place between the two midsole layers. Midsole layer 46 is adhered to the upper's bottom 16, and outsole 40 is adhered to midsole layer 47. The midsole and heel plate unit (42, 44) is therefore sandwiched between bottom 16 and outsole 40.

Plate 44 extends throughout the interface between layers 46 and 47 and is formed from any suitable, substantially non-stretching stiff material. For example, it may be a stiff sheet formed from polyester resin and woven or chopped fiberglass in which the amount of fiberglass present is equal to approximately 25% by weight of the sheet.

As shown in FIGS. 4 and 8, outsole 40 extends upwardly along the back of the heel and also upwardly along the lateral and medial sides of the heel. The bottom corners of outsole 40 lying along both sides and at the rear of the heel are smoothly rounded to eliminate any sharp corner edges which would tend to catch on a court surface. The bottom corners of midsole layer 47 may be squared so that when midsole 42 is compressed they deform to interfit with the rounded corners of outsole 40.

As shown in FIG. 4, the forward end portions of midsole layers 46 and 47 and heel plate 44 are tapered to smoothly merge with coupling 15 which is defined by the unsoled midfoot region of bottom 16. Outsole 40 also terminates at its forward end in a flexible tapered lip portion 52 which extends slightly beyond midsole layer 47. Lip portion 52 underlies and is adhered to the rearward end region of the saddle's bottom portion 33. Lip portion 52 is very thin so that it does not impair the flexibility of coupling 15. Except for the tapered end portion 52, the thickness of outsole 40 underlying midsole layer 47 is substantially uniform. Except for its tapered end, each of the midsole layers 46 and 47 is also of uniform thickness.

Upon impact of the heel on the ground, the closed foam of midsole 42 compresses to absorb the impact energy. The configuration of the human heel is such that without plate 44, the midsole's central region under the calcaneus will become highly compressed before the rest of the midsole begins to compress. Most of the energy will therefore be absorbed in the midsole's central region, and very little energy will be absorbed in the rest of the midsole. Without plate 44, a greater compressible midsole thickness is consequently required to absorb a given amount of energy as compared with a condition where the midsole is uniformly compressed by the load. The nonuniform compression of the midsole also has the objectionable effect of causing the highly compressed midsole region to degrade more than the rest of the midsole.

In this invention, heel plate 44 is stiff enough to more uniformly distribute the heel load over midsole 42 so that midsole 42 will compress more uniformly upon impact. As a result, plate 44 enables the thickness of midsole 42 to be reduced to place the wearer's heel closer to the ground without diminishing the amount of energy absorbed by midsole compression and, consequently, without causing discomfort due to impact. By more uniformly distributing the heel load on midsole 42, plate 44 also reduces the extent of localized degradation in the midsole region under the calcaneus.

In this invention, heel plate 44 is somewhat flexible so that upon impact, it will deflect under the heel load to conform to the configuration of the wearer's heel (see FIG. 9) to make the shoe feel comfortable. If plate 44 is made so stiff to be unflexible, midisole 42 would feel uncomfortably hard, especially where the impact is great enough to cause the heel to bottom out on the heel plate. The desired stiffness of plate 44 therefore lies between two extremes, one being where the plate is so stiff that it will not deflect to any appreciable extent under the heel load, and the other being where the plate is so flexible that it approaches the condition which arises when the heel plate is removed.

Figure 9:
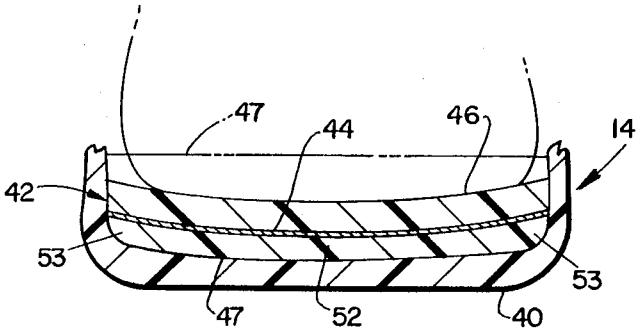
FIG. 9 is a section similar to FIG. 7, but showing the rearfoot midsole unit in its loaded, deformed state.

FIG. 9 shows the compression of midsole 42 and the deflection of plate 44 for a typical dynamic heel load. In this figure, the uncompressed configuration of midsole 42 and the undeflected state of plate 44 are shown in phantom lines.

Referring to FIG. 9, the radius of curvature of plate 44 in its deflected condition it about 8.0" for a normal peak heel load of about 375 lbs. Because of this deflection, midsole 42 will deform to cup the wearer's heel for the wearer's comfort. Furthermore, midsole 42 will be compressed throughout its entire width, although the extent of compression in the central region 51 under the calcaneus is somewhat more than the midsole compression in regions 53 adjacent to the side edges of sole unit 14.

The desired stiffness of plate 44 may be obtained by varying either the plate's thickness or the plate's modulus of elasticity, or both, within certain limits. Increasing the heel plate thickness and/or the modulus of elasticity obviously increases the stiffness of plate 44. The same stiffness of plate 44 can be achieved with different combinations of values for the plate thickness and modulus of elasticity. Thus, an increased heel plate thickness may be offset by decreasing the plate's modulus of elasticity, and an increased modulus of elasticity may be offset by decreasing the plate's thickness.

To provide plate 44 with the desired stiffness, the heel plate's modulus of elasticity or bending modulus, as it is also called, is required to lie in a range extending from about 500,000 psi to about 10,000,000 psi for a minimum plate thickness of about 0.020". Decreasing either the plate thickness or the modulus of elasticity below the foregoing minimum values results in a plate which is too flexible and which therefore does not adequately distribute the heel load over the entire area of the midsole.

A heel plate having a thickness of about 0.060" and a modulus of elasticity not exceeding about 10,000,000 psi may also be acceptable. Increasing the plate thickness above 0.060" for a plate having a modulus of elasticity of about 10,000,000 psi, however, makes the heel plate too stiff, causing a discomforting concentration of pressure under the calcaneus. Increasing the modulus of elasticity above 10,000,000 psi for a plate thickness of about 0.060" also makes the plate too stiff.

For a low modulus of elasticity of about 500,000 psi, the plate thickness may be as much as approximately 0.100". Increasing the plate thickness above 0.100" while reducing the modulus of elasticity is counterproductive because the total thickness of the midsole/heel plate unit (42, 44) becomes unacceptably thick and thereby places the wearer's heel too high above the ground.

Although the plate thickness can be increased to about 0.100" for a low modulus of about 500,000 psi, the preferred thickness range extends from about 0.020" to about 0.080".

For the previously described heel plate construction, plate 44 has a preferred thickness of about 0.040" and a preferred modulus of elasticity of about 1.5 million psi.

From the foregoing description it will be appreciated that plate 44 enables the thickness of midsole 42 to be reduced significantly to reduce the height of the wearer's heel above the ground without causing discomfort. In contrast to the raised, thickly cushioned heel of a conventional tennis shoe, the heel support surface in the shoe of this invention is considerably lower and is at least approximately on the same level as the forefoot support surface as described in greater detail below.

The maximum, overall thickness of the rearfoot sole unit 14 extending from the bottom of outsole 40 to the upwardly facing side of midsole layer 46 is preferably equal to or closely equal to the maximum, overall forefoot thickness extending from the bottom of outsole 32 to the upwardly facing side of board 25. Sockliner 28 and heel pad 29 are highly compressible and thin when compressed so that they do not add to the above-ground height of the wearer's forefoot and rearfoot to any significant extent.

The sockliner's forefoot and rearfoot support regions therefore lie in or at least approximately in a common plane which, in turn, extends parallel to or at least approximately parallel to the ground surface on which the shoe is placed. By this construction it will be appreciated that the wearer's forefoot and rearfoot are placed at or approximately at a common level which is parallel or at least closely parallel to the ground surface. Heel pad 29, when used, does not lift the wearer's heel above the forefoot to any noticeable or significant extent.

By keeping the wearer's rearfoot low to the ground along with the wearer's forefoot, the wearer has more stability and balance. Furthermore, by reducing the thickness of the rearfoot sole unit 14 through the utilization of plate 44, the loading exerted by the wearer is transferred or shifted forwardly. The lowness of the heel in the tennis shoe of this invention thus induces the tennis player to stay up on the balls of his feet in a preferred tennis-playing posture.

The reduction of the thickness of sole unit 14 through the use of stiffening plate 44 has the additional, significant advantage of shortening the moment arm R (FIG. 4) lying between the wearer's ankle joint and the point P (see FIG. 4) at the rearward edge of the heel sole unit 14 by effectively moving point P up towards the ankle. Under conditions where the player steps out and strikes the court surface first at point P, he pivots about point P to slap his forefoot down on the court surface. By shortening the moment arm R, the forefoot slaps less hard than it would in the case of a conventional shoe having a raised heel and hence a longer moment arm. Shortening the moment arm therefore reduces the shock due to slap-down of the forefoot. Reduction of the shock on the forefoot, in turn, permits the thickness of the forefoot midsole 34 to be reduced without causing discomfort. The low foot support surface in the shoe of this invention also advantageously reduces the angle through which the wearer must lean in a forward direction to transfer his load to the ball of his foot and to thereby lock up his midfoot in order to propel himself.

In one example of the tennis shoe described above, the overall thickness of the rearfoot midsole 42 and plate 44 is preferably about 9/32", the thickness of each of the midsole layers 46 and 47 is preferably about $\frac{1}{8}$", and the thickness of the rearfoot outsole 40 is preferably about $\frac{1}{8}$" so that the overall thickness of the rearfoot sole unit 14 is relatively small and is on the order of 13/32". At the forefoot region, the thickness of the midsole 34 is preferably about $\frac{1}{8}$" and the thickness of outsole 32 is preferably about 3/16". The thicknesses of insole board 25 and toe plate 24 are relatively small so that the overall thickness of the composite of insole board 25, toe plate 24 and sole unit 12 is also about 13/32". The sum of the compressed thickness of sockliner 28 and heel pad 29 is less than $\frac{1}{8}$" so that in the illustrated embodiment the height of the foot above the ground is less than about 17/32" and preferably does not exceed $\frac{5}{8}$".

From the foregoing description it will be appreciated that in order to place the wearer's heel close to the ground in accordance with the major object of this invention, the thickness of each of the midsole layers 46 and 47 is required to be relatively small and is preferably about $\frac{1}{8}$". Because of the small thickness of the upper midsole layer 46, it is important that plate 44 be deflectable to an extent that enables the midsole/plate unit (42, 44) to cup the wearer's heel so that the shoe feels comfortable.

The extent to which plate 44 is deflectable under a given load depends not only on its stiffness, but also on the thickness of the upper midsole layer 46. In this regard, decreasing the thickness of midsole layer 46 increases the load concentration under the heel, which in turn increases the extent of deflection of plate 44. Conversely, increasing the thickness of midsole layer 46 decreases the load concentration to decrease the extent of heel plate deflection. If, for example, the thickness of midsole layer 46 were increased to about $\frac{3}{8}''$ and plate 44 were made relatively stiff (such as one having a thickness of about 0.060" or more and modulus of elasticity of about 1,000,000 psi or more), plate 44 would not deflect to any significant extent under a normal heel load. Aside from the effect on plate 44, it is evident that an upper midsole layer thickness of about $\frac{3}{8}''$ makes the midsole/heel plate unit (42, 44) unacceptably thick because it places the heel too high above the ground.

From the foregoing description it is clear that the stiffness range throughout which plate 44 is deflectable to an acceptable extent depends on the thickness which is selected for the upper midsole layer 46. The upper limits of the ranges set forth above for the thickness and modulus of elasticity of plate 44 are based on an upper midsole layer thickness of about $\frac{1}{8}''$.

Because of the deflection of plate 44 under the wearer's heel load, both of the midsole layers 46 and 47 will operate to cushion the wearer's heel in the sense that they will compress to a greater extent in the region underlying the wearer's calcaneus as shown in FIG. 9.

Because of the soleless midfoot coupling construction between sole units 12 and 14, the two sole units are interconnected only through the upper's highly flexible midfoot region of bottom 16 which is formed by the pliable bottom portions of panels 17 and 18 and the pliable saddle bottom 33. When the shoe is laced up, saddle 31 provides a secure girth-like grip around the foot in the midfoot region and flexibly hugs the foot just in the midfoot region without constraining the natural motions of the different parts of the wearer's foot. Preferably the lacing lying forwardly of saddle 31 in the forefoot region is looser than the lacing adjacent to the saddle's side portions 35 and 37 to avoid constraints on the forefoot. This may be accomplished with a dual lacing system.

From the foregoing description it also will be appreciated that flexible coupling 15 removes the constraints which exist in conventional tennis shoes between the forefoot and rearfoot. Coupling 15 thus allows virtually unrestrained relative motion between the wearer's rearfoot or heel and the forefoot so that the rearfoot and forefoot are free to act independently of each other in the manner that they do when the person is barefooted.

Because the thicknesses of sole units 12 and 14 are very small, the soleless, flexible midfoot coupling 15 is also very low to the ground. This feature together with fhe lack of any longitudinal medial arch support in the shoe places the shoe's midfoot load-bearing region under the long outside arch much lower to the ground as compared with conventional tennis shoes. This construction significantly reduces the chances of ankle sprain and enhances the wearer's stability and balance.

Instead of being flat-sided as shown, plate 44 may be contoured.

It will be appreciated that the construction of the left foot athlete shoe is the mirror image of the illustrated right foot shoe. It also will be appreciated that plate 44 is springy in the sense that it will return to its illustrated undeflected state when deflecting forces are removed.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An athletic shoe for tennis or other court games comprising a foot-receiving, sliplasted upper and separately formed first and second sole units, said upper being formed of flexible but essentially inelastic panels extending from end to end of said shoe and forming a flexible bottom underlying the wearer's foot along the length of said shoe, said sole units being spaced apart from each other and being connected together only through said upper, said first sole unit underlying the foorefoot of the wearer and terminating near the interface between the wearer's forefoot and midfoot, and said second sole unit underlying just the wearer's rearfoot, the portion of the flexible bottom underlying the midfoot and extending between said sole units forming an unsoled, flexible coupling, flexibly interconnecting said sole units, said first sole unit comprising a first midsole attached to said upper and a first outsole adhered to said first midsole, said second sole unit comprising a second midsole adhered to said flexible bottom and a second outsole adhered to said second midsole, each of said first and second midsoles being formed from a resilient, energy-absorbing, foamed polymeric material, the thickness of said second sole unit under the calcaneus being at least substantially uniform along the longitudinal axis of the athletic shoe.

2. The athletic shoe defined in claim 1, including a forefoot board underlying, only the wearer's forefoot, said forefoot board overlying said first sole unit and being sufficiently stiff to keep the forefoot support surface in said upper at least substantially flat across the width of said upper.

3. The athletic shoe defined in claim 2 wherein the shoe thickness extending from the group-engaging side of said second outsole to the upwardly facing side of said flexible bottom in the rearfoot region is at least approximately equal to the shoe thickness extending from the ground-engaging side of said first outsole to the upwardly facing side of said forefoot board.

4. The athletic shoe defined in claim 3 wherein said flexible bottom has an opening underlying a region of the wearer's toes, there being a stiff toe plate disposed in said opening under said forefoot board for reinforcing said board.

5. The athletic shoe defined in claim 4 wherein said board overlies and is adhered to a forefoot portion of said flexible bottom by a stiff layer of adhesive which provides additional reinforcement for said board.

6. The athletic shoe defined in claim 2 wherein said board overlaps and is adhered to said flexible bottom.

7. The athletic shoe defined in claim 2 including a pliable sockliner disposed in said upper, said sockliner overlying and being adhered to said board and to said flexible bottom in the region lying rearwardly of said board, said sockliner lying at a level which places the wearer's forefoot and rearfoot at least approximately at a common level which extends at least approximately parallel to the ground surface.

8. The athletic shoe defined in claim 1 wherein said upper includes pliable side wall portions, a pliable bottom wall portion and a saddle exteriorly affixed to said side and bottom wall portions, said saddle extending along and underlying said bottom wall portion only in the region underlying the wearer's midfoot to define a layer of said flexible bottom, and said saddle further having side portions extending upwardly along said side wall portions to cradle the wearer's foot.

9. The athletic shoe defined in claim 1 wherein said second midsole is horizontally divided into upper and lower layers, and wherein a heel plate is disposed between and is adhered to opposing surfaces of said upper and lower layers, said plate extending throughout the interface between said upper and lower layers, said plate being sufficiently stiff to more uniformly distribute the wearer's load on said second midsole, but being flexible enough to be deflected by said load to cup the wearer's heel.

10. The athletic shoe defined in claim 9 wherein the thickness of said plate is at least approximately 0.020", and wherein said plate has a modulus of elasticity lying in a range extending from about 500,000 psi to about 10,000,000 psi and wherein the thickness of said upper layer is approximately $\frac{1}{8}$".

11. The athletic shoe defined in claim 10 wherein the thickness of said plate does not exceed about 0.060" for the maximum modulus of elasticity of about 10,000,000 psi.

12. The athletic shoe defined in claim 9 wherein said plate has a thickness of about 0.040" and a modulus of elasticity of about 1.5 million psi.

13. The athletic shoe defined in claim 9 wherein the thickness of each of said layers is about $\frac{1}{8}$".

14. The athletic shoe defined in claim 13 wherein the thickness of said first midsole is about $\frac{1}{8}$".

15. The athletic shoe defined in claim 9 wherein the thicknesses of said first layer, said second layer and said first midsole are about equal.

16. The athletic shoe defined in claim 15 including means overlying said sole units and terminating in an upwardly facing foot-engaging surface in said upper, the regions of said foot-engaging surface underlying the wearer's forefoot and rearfoot lying at least approximately at a common level above the ground surface which extends at least approximately parallel to the ground.

17. An athletic shoe for tennis or other court games comprising a foot-receiving upper, separately formed forefoot and rearfoot sole units, said upper having a flexible bottom underlying the wearer's foot and extending throughout the region underlying at least the wearer's midfoot and rearfoot to define a sliplasted upper construction in at least the wearer's midfoot and rearfoot regions, said sole units being spaced apart from each other and being connected together only through said upper, said forefoot sole unit underlying just the forefoot of the wearer, said rearfoot sole unit underlying just the wearer's rearfoot, said flexible bottom having a portion underlying the midfoot and extending between said sole units to form an unsoled, flexible coupling flexibly interconnecting said sole units to allow the wearer's forefoot and rearfoot to act independently of each other, said forefoot sole unit comprising a first midsole attached to said upper and a first outsole adhered to said first midsole, said rearfoot sole unit comprising a second midsole adhered to said flexible bottom and a second outsole adhered to said second midsole, each of said first and second midsoles being formed from a compressible, energy-absorbing, foamed polymeric material, said second midsole being horizontally divided into upper and lower layers, and means cooperating with said second midsole for enabling the thickness of said second midsole to be reduced without reducing the energy which said second midsole is capable of absorbing, said means comprising a heel plate forming a part of said rearfoot sole unit and underlying just the wearer's rearfoot, said plate being disposed between and adhered to opposing surfaces of said upper and lower layers, said plate extending throughout the interface between said upper and lower layers, said plate being sufficiently stiff to spread the wearer's heel load over said second midsole, but being flexible enough to deflect under the influence of said load to curved configuration, the thickness of said forefoot sole unit being at least substantially uniform in the region underlying the wearer's forefoot, the thickness of said rearfoot sole unit being at least substantially uniform in the region underlying the wearer's rearfoot, a forefoot board disposed in said upper above said forefoot sole unit and underlying a portion of the wearer's forefoot, said board overlapping and being adhered to a portion of said flexible bottom, said board being sufficiently stiff to keep the forefoot support surface in said upper flattened throughout the width of said upper, and thin cushioning means disposed in said upper and having an upwardly facing foot-engaging surface region, said cushioning means overlying said board and the portion of said flexible bottom lying rearwardly of said board, the thickness of said sole units, said board, said flexible bottom and said cushioning means being such that the wearer's forefoot and rearfoot are supported in at least approximately in a common plan which extends at least approximately parallel to the ground surface.

18. An athletic shoe for tennis and other court games comprising a foot-receiving upper and a sole unit underlying the wearer's heel, said sole unit comprising a ground-engaging outsole and a midsole lying between said upper and said outsole and formed from a compressible, energy-absorbing, foamed polymeric material, said midsole being divided into upper and lower layers, said lower layer being adhered to said outsole and said upper layer being affixed to said bottom portion, and means forming a part of said sole unit for enabling the thickness of said midsole to be reduced without correspondingly reducing energy which said midsole is capable of absorbing, said means comprising a heel plate disposed between and adhered to opposing surfaces of said upper and lower layers, said plate extending throughout the interface between said layers and being sufficiently stiff to spread the wearer's heel load on said upper layer, said upper layer being sufficiently thin and said plate being sufficiently flexible that said plate will deflect in the region underlying the wearer's calcaneus under a heel load of at least about 375 lbs.

19. The athletic shoe defined in claim 18 wherein said polymeric material is ethylene vinyl acetate and has closed gas filled cells.

20. The athletic shoe defined in claim 18 wherein the thickness of said sole unit under the wearer's calcaneus is at least substantially uniform.

21. The athletic shoe defined in claim 20 wherein the thickness of each of said layers is at least substantially uniform in the region underlying the wearer's calcaneus.

22. The athletic shoe defined in claim 21 wherein the thickness of said upper layer under the wearer's calcaneus is about $\frac{1}{8}$".

23. The athletic shoe defined in claim 22 wherein the thickness of said lower layer under the wearer's calcaneus is about $\frac{1}{8}$".

24. The athletic shoe defined in claim 22 wherein the thickness of said plate is at least approximately 0.020" and has a modulus of elasticity in a range extending from about 500,000 psi to about 10,000,000 psi, and wherein the thickness of said plate does not exceed approximately 0.060" where the modulus of elasticity is about 10,000,000 psi.

25. The athletic shoe defined in claim 18 wherein said plate has a thickness of about 0.040" and a modulus of elasticity of about 1.5 million psi.

26. An athletic shoe for tennis comprising a foot-receiving upper, separately formed forefoot and rearfoot sole units, said upper having an intermediate, flexible portion extending along the wearer's midfoot region, said flexible portion comprising a saddle formed form a stretch resistant material and terminating at its upper ends at eyelet portions said sole units being spaced apart from each other and being connected together only through said flexible portion of said upper, said forefoot sole unit underlying just the wearer's forefoot, said rearfoot sole unit underlying just the wearer's rearfoot, said intermediate flexible portion of said upper extending between said sole units to form an unsoled flexible coupling flexibly interconnecting said sole units to allow the wearer's forefoot and rearfoot to act independently of each other, said forefoot sole unit comprising a first outsole and a first intermediate sole overlying and fixed to said first outsole, said rearfoot sole unit comprising a second outsole and a second intermediate sole overlying and fixed to said second outsole, said forefoot and rearfoot sole units being fixed to said upper, and each of said first and second intermediate soles being formed from a compressible energy-absorbing closed cell foamed polymeric material.

27. The athletic shoe defined in claim 26 wherein said saddle is formed from leather.

28. The athletic shoe defined in claim 27 wherein said saddle is formed from a plastics material.

29. The athletic shoe defined in claim 26 including means overlying said forefoot and rearfoot sole units and having a foot-engaging surface in said upper, the thickness of said means and said forefoot and rearfoot sole units being such that the wearer's forefoot and rearfoot are supported in at least approximately a common plane which extends at least approximately parallel to the ground surface.

* * * * *